United States Patent [19]

Forsell et al.

[11] Patent Number: 4,528,539

[45] Date of Patent: Jul. 9, 1985

[54] REDUCED-SIZE THERMAL OVERLOAD RELAY

[75] Inventors: Kenneth A. Forsell, Port Washington; Edward A. Mallonen, New Berlin, both of Wis.

[73] Assignee: Eaton Corporation, Cleveland, Ohio

[21] Appl. No.: 625,488

[22] Filed: Jun. 28, 1984

[51] Int. Cl.[3] ..... H01H 37/70

[52] U.S. Cl. ..... 337/49; 337/38

[58] Field of Search ..... 337/49, 38, 36, 47, 337/48, 35, 103, 104

[56] References Cited

U.S. PATENT DOCUMENTS

| | | | |
|---|---|---|---|
| 2,798,140 | 7/1957 | Kohring | 201/56 |
| 3,316,374 | 4/1967 | Nelson | 200/122 |
| 3,564,475 | 2/1971 | Fujii et al. | 338/120 |
| 3,792,401 | 2/1974 | Anderson | 337/49 |
| 3,800,260 | 3/1974 | Woodger | 337/49 |
| 4,096,465 | 6/1978 | Fryer | 337/49 |
| 4,203,025 | 5/1980 | Nakatani et al. | 219/216 |
| 4,204,107 | 5/1980 | Ohkubo et al. | 219/216 |
| 4,237,442 | 12/1980 | Carter | 338/180 |
| 4,242,565 | 12/1980 | Schoon | 219/216 |
| 4,410,874 | 10/1983 | Scapple et al. | 338/307 |
| 4,413,170 | 11/1983 | Val et al. | 219/216 |

*Primary Examiner*—Harold Broome

*Attorney, Agent, or Firm*—C. H. Grace; W. A. Autio

[57] ABSTRACT

A reduced-size thermal overload relay having a housing (2) that includes three narrow compartments (2*k*, 2*l*, 2*m*) in which are mounted three connector brackets (16,18,20) supporting three flat bimetal members (16*j*, 18*j*, 20*j*). Three narrow cassette heaters (6,8,10) are mounted at the upper part of the housing and held in by a snap-in hold-down device (12) that engages pairs of hooks (6*b*, 7*b*) at the lower portions of the heaters. A pushbutton (12*a*) on the hold-down device extends through a hole (3*c*) in the front wall of the housing for manual depression to release the heaters for removal. Each bracket (16) is H-shaped having legs (16*c*, 16*d*) for mounting it in a housing compartment (2*k*) and arms (16*a*, 16*b*) connected by a platform (16*e*) to which the upper terminal clip (6*d*) of the cassette heater is clamped with a screw (16*q*), the small angles of this platform and terminal clip automatically drawing the flat heater element (6*c*) into desired spacing with the bimetal member. The current flow down the arms (16*a*, 16*b*) prevents loss of heat through the terminal lead (16*h*). A switch (4) mounted at the side of the housing is tripped by a joint or differential operating mechanism (28,30,32) mounted below the three compartments and actuated by the three deflecting bimetal members.

14 Claims, 20 Drawing Figures

Fig. 4
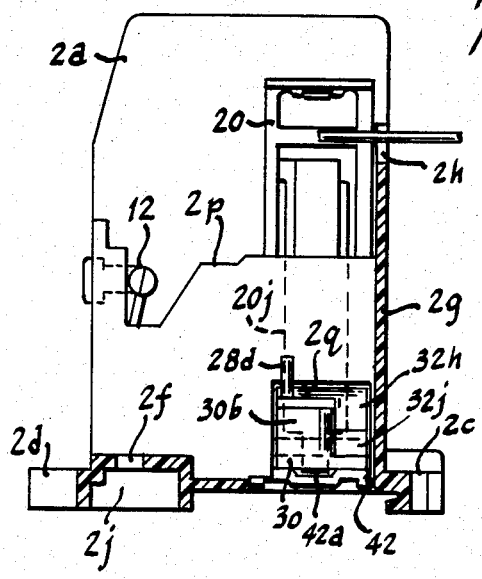
Fig. 7
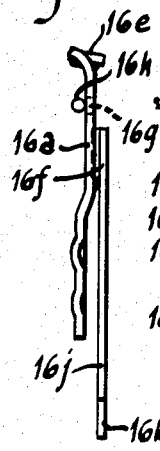
Fig. 6
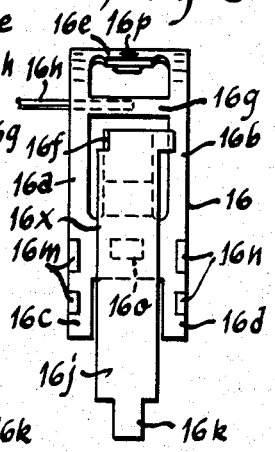
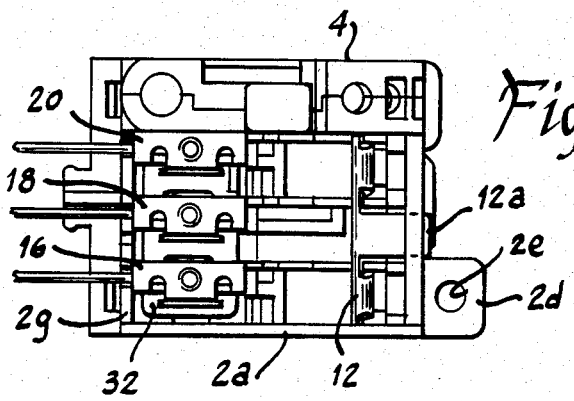
Fig. 5
Fig. 8
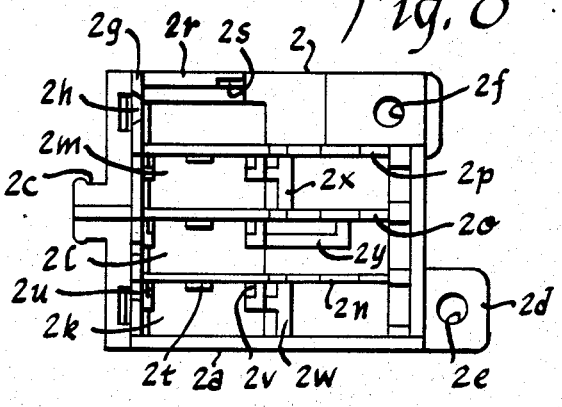

Fig. 10
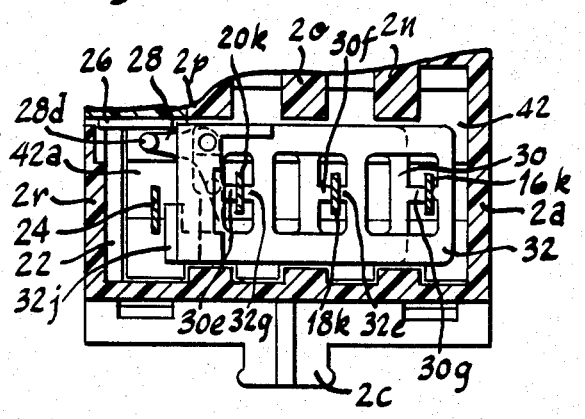
Fig. 19
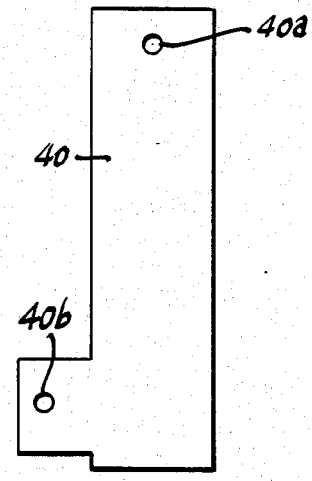
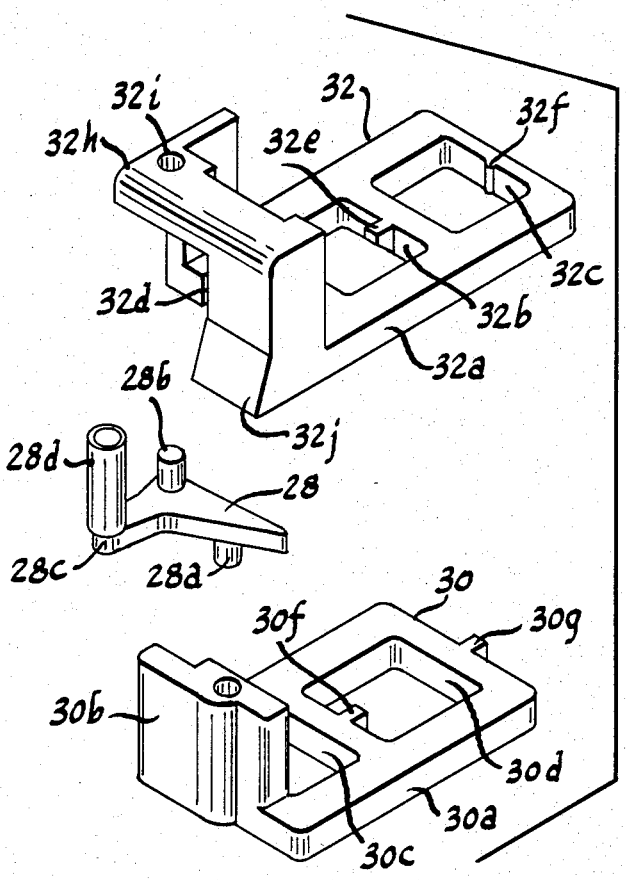
Fig. 11

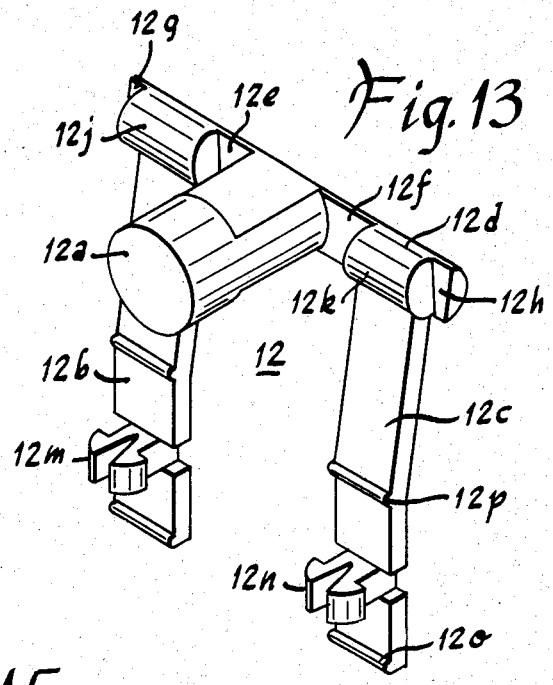
Fig. 13
Fig. 15
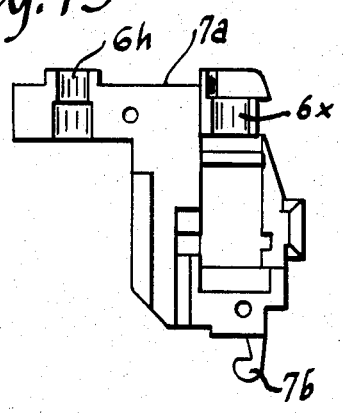
Fig. 14
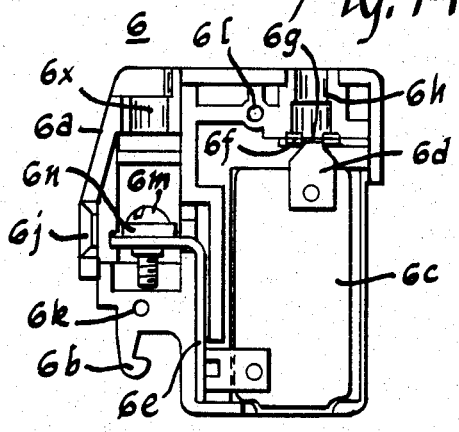
Fig. 17
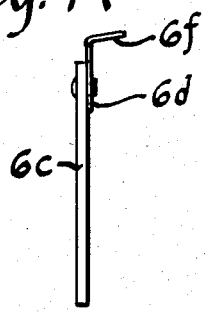
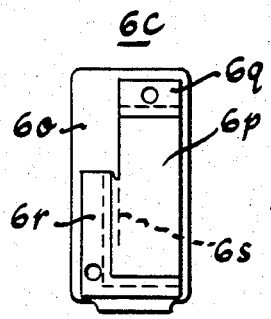
Fig. 16

REDUCED-SIZE THERMAL OVERLOAD RELAY

BACKGROUND OF THE INVENTION

Thermal overload relays have been known heretofore. For example, P. C. Fryer U.S. Pat. No. 4,096,465, dated June 20, 1978, shows a thermal overload relay intended to be connected in a three-phase power supply to a three-phase motor which includes means responsive to the currents in the individual phases and a contact-breaking switch arranged to be actuated by the current responsive means in the event of the current on all three phases exceeding a threshold and also in the event of a differential, above a second threshold, and with the magnitude of the second, or differential threshold increasing with the mean value of the currents of all phases.

While prior thermal overload relays such as that represented by the Fryer patent have been useful for their intended purposes, this invention relates to improvements thereover.

SUMMARY OF THE INVENTION

An object of the invention is to provide an improved reduced-size thermal overload relay.

A more specific object of the invention is to provide a thermal overload relay with improved modular or cassette-type, replaceable heaters for the respective phases of the power supply.

Another specific object of the invention is to provide a thermal overload relay with an improved cassette heater of the thick film type capable of handling a range of wattage and higher electrical power than prior types.

Another specific object of the invention is to provide a thermal overload relay with a snap-in removable cassette-type resistance heater which can readily and economically be given a very precise resistance value.

Another specific object of the invention is to provide a thermal overload relay of the three-phase type with heaters having a thin configuration thereby contributing to a reduced-size thermal overload relay.

Another specific object of the invention is to provide a thermal overload relay with a cassette resistance heater constructed so that the start or motor inrush current heat is readily dissipated therein.

Another specific object of the invention is to provide a reduced-size plural-phase thermal overload relay that can accommodate any one of a plurality of selected sets of thin cassette-type heaters having thick film or flat resistance material elements of different ratings.

Another specific object of the invention is to provide a reduced-size plural-phase thermal overload relay with improved bimetal carrying terminal brackets press-in mounted in the relay housing and improved thin cassette-type resistance heaters snap-in mounted in the relay housing both constructed so that when the heaters are electrically connected to the terminal brackets the spacing between the bimetals and the resistance elements of the heaters is automatically set the same on all the phases.

Another specific object of the invention is to provide a plural-phase thermal overload relay with a housing having compartments for the thermal elements of the different phases with improved bimetal-carrying terminal brackets constructed so as to lessen the magnetic effect under short circuit conditions.

Another specific object of the invention is to provide a thermal overload relay with an improved bimetal-carrying terminal bracket mounted in the relay housing with mechanical isolation through a resilient section to an external conductor or lead so as to prevent movement of the bimetal with respect to a closely spaced heater when electrical connections are made.

Other objects and advantages of the invention will hereinafter appear.

These and other objects of the invention are obtained by providing a reduced-size thermal overload relay for a control system having a plural-phase A.C. source supplying a load comprising an insulating open-top housing having a plurality of narrow compartments at its lower portion and a lateral space therebelow, a plurality of thermal responsive means for the respective phases of said system, a plurality of conductive brackets mounted in said housing supporting said thermal responsive means so as to extend down through said compartments into said space therebelow, a plurality of terminal leads connected to the respective brackets for connection to an external device, a plurality of narrow cassette heaters at the top of said housing having flat heater elements mounted in insulating enclosures leaving one side of said heater elements exposed and terminals for electrically connecting said heater elements to the respective phases of said system to be heated by the currents therein, connecting and positioning means for electrically connecting said heater elements to the respective brackets and therethrough to said terminal leads and concurrently positioning said exposed sides of said heater elements relative to the respective thermal responsive means to heat the latter according to the currents in the respective phases of said system, a switch mounted at one side on said housing and having terminals connectable to a control device for protection of said system, and actuator means in said space below said compartments responsive to said thermal responsive means under overload conditions for operating said switch.

BRIEF DESCRIPTION OF THE DRAWINGS

FIG. 4 is a cross sectional view taken substantially along line 4—4 of FIG. 2 to show a right side view of one of the bimetal carrying terminal brackets and the relation of the bimetal to the differential actuating bars.

FIG. 5 is a top view of the overload relay of FIG. 2.

FIG. 6 is a left side elevational view of one of the three bimetal-carrying terminal brackets.

FIG. 7 is a rear edge view of the bimetal-carrying terminal bracket of FIG. 6.

FIG. 8 is a top view of the base or housing of the overload relay of FIGS. 2–4 with the three bimetal-carrying terminal brackets and the snap-in hold-down device removed therefrom to show the compartments and mounting means therein.

FIG. 10 is a cross sectional view taken substantially along line 10—10 of FIG. 9 to show a top view of the differential bars and the crank and the relationship of the crank to the switch actuating member.

FIG. 11 is an enlarged exploded isometric view of the differential bars and the crank.

FIG. 13 is an enlarged isometric view of the snap-in hold-down member shown in side view in FIG. 3.

FIG. 14 is a right side view of one of the three heater pack or cassette assemblies with the cover removed to show the interior structure thereof.

FIG. 15 is a left or interior view of the cover for the cassette heater of FIG. 14.

FIG. 16 is a right side elevational view of a thick film heater used in the heater cassette assembly of FIGS. 14–15.

FIG. 17 is a front view of the thick film heater of FIG. 16 showing the upper terminal clip connected thereto.

FIG. 19 is a right side elevational view of a flat resistance material heater for alternative use in a cassette heater of the type shown in FIGS. 14–15, this resistance material heater element having a different current rating from the thick film heater shown in FIGS. 16–17.

DESCRIPTION OF THE PREFERRED EMBODIMENT

Figure 1:
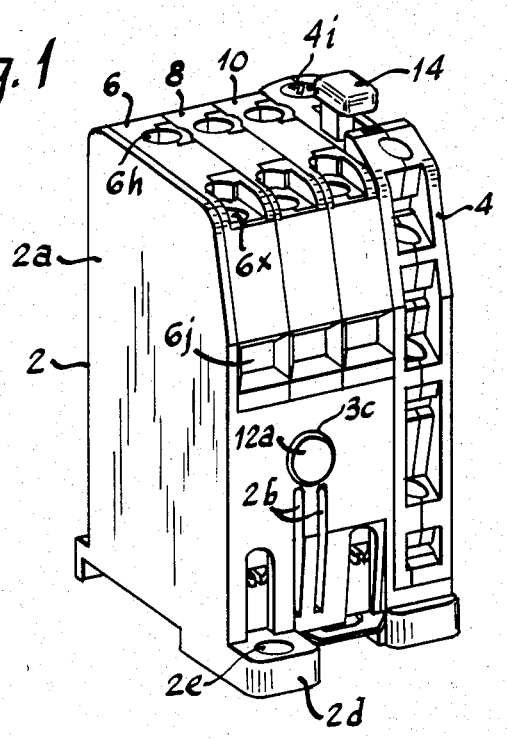
FIG. 1 is an isometric view of the three-phase reduced-size thermal overload relay constructed in accordance with the invention.

Referring to FIG. 1, there is shown a reduced-size thermal overload relay constructed in accordance with the invention. The size of this relay is less than two inches wide, less than two inches deep in its major body portion not counting its lower extensions whereby it is secured to a mounting panel which add substantially three-fourths of an inch to its depth, and substantially three and one-half inches high. As shown in FIGS. 1–4 this thermal overload relay is provided with a molded plastic insulating housing 2 having a switch 4 secured to the housing at its right-hand side, and three cassette heaters 6, 8 and 10 at its upper portion mounted between switch 4 and left wall 2*a* of the housing. A release button 12*a* of a snap-in hold-down device 12 extends out through a hole 3*c* in the front wall of the housing below heaters 6, 8 and 10 which may be depressed to release the cassette heaters for removal as hereinafter more fully described. A reset button 14 extends up through a hole in the top of switch 4 for resetting the switch closed after it has been tripped open. Housing 2 has a pair of ventilating slots or openings 2*b* in its front wall for releasing heat from the interior of the housing. Housing 2 has a mounting lug 2*c* at the central lower portion of its rear wall as shown in FIG. 3 for securing the relay to a device such as a contactor to which it may be attached and connected. Housing 2 also has an extension or projection 2*d* at its lower left front corner with a vertical hole 2*e* therethrough for receiving a screw or the like for attaching the relay to a mounting panel or base or the like.

Figure 2:
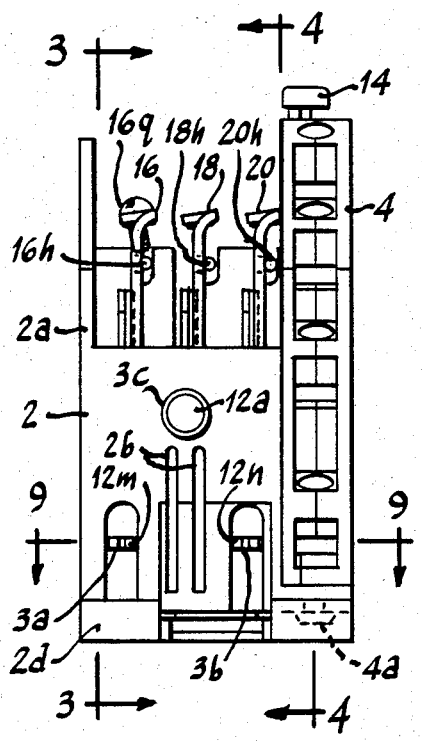
FIG. 2 is a front elevational view of the overload relay of FIG. 1 with the three cassette heaters removed to show the terminal brackets therein.
Figure 3:
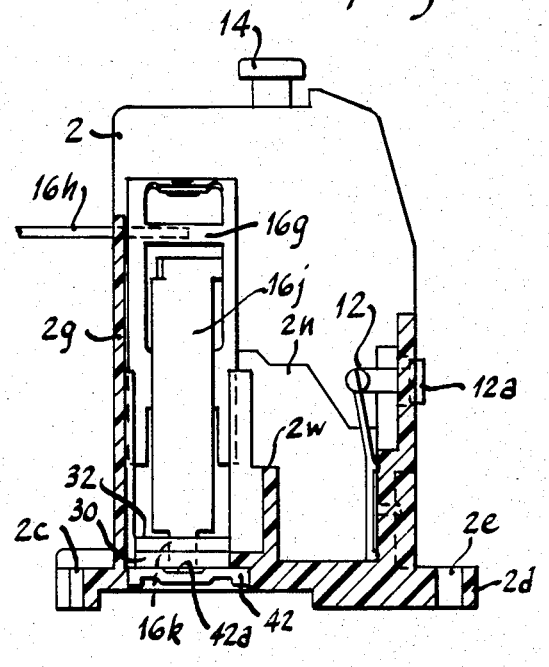
FIG. 3 is a cross sectional view taken substantially along line 3—3 of FIG. 2 to show one of the three bimetal-carrying terminal brackets with the screw removed and the snap-in hold-down device for the cassette heaters.
Figure 12:
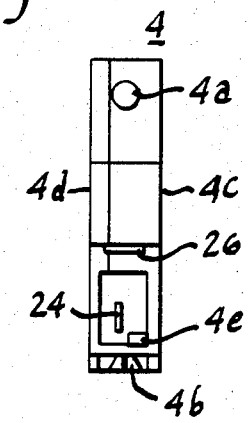
FIG. 12 is a bottom view of the switch of FIG. 20 showing the staking lug and the dovetail projection whereby the switch is secured to the relay housing.

Relay housing 2 and switch 4 are provided with means for rigidly securing the same to one another at two places shown in FIGS. 2, 4 and 12. For this purpose, relay housing 2 is provided with a hole 2*f* shown in FIG. 4 at is lower right front portion for receiving an integrally molded cylindrical projection 4*a* shown in FIGS. 12 and 20. Also, the upper right portion of the rear wall 2*g* of relay housing 2 is provided with a laterally outwardly flared slot 2*h* extending a short distance down from the upper edge of wall 2*g* shown in FIGS. 4 and 8 for receiving a dovetail lug 4*b* shown in FIGS. 12 and 20. To assemble the switch 4 onto the relay housing, projection 4*a* is first inserted into hole 2*f* and lug 4*b* is aligned with slot 2*h* and the switch is then pressed down until it bottoms with lug 4*e* sliding behind wall 2*r*. As a result, projection 4*a* extends through hole 2*f* and into cavity 2*j* in the bottom of the relay housing. The lower end of projection 4*a* may then be staked by applying heat and pressure or the like as shown in broken lines in FIG. 2 to permanently and rigidly secure the switch to the relay housing. It will be apparent in FIG. 12 that dovetail lug 4*b* is molded partly integrally with base 4*c* of the switch and is molded partly integrally with cover 4*d* of the switch so that this divided lug not only retains the switch on the relay housing but also helps to clamp the cover 4*d* of the switch to the switch base 4*c* in addition to other securing means such as rivets 4*f* and 4*g*, FIG. 20, used therefor. FIG. 8 which is a top view of the relay housing more clearly shows hole 2*f* and flared slot 2*h* which are used for securing the switch to the relay housing.

Figure 9:
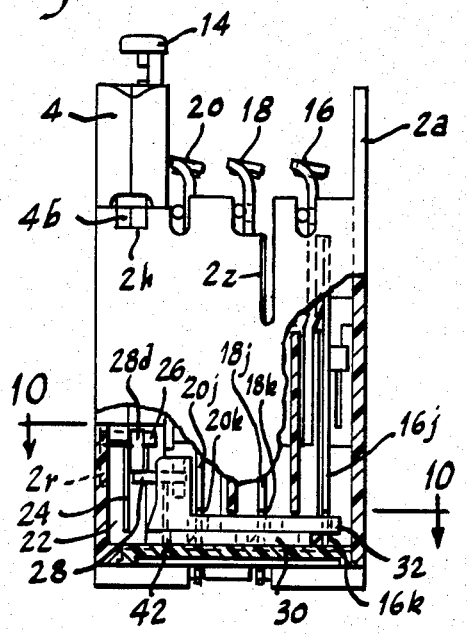
FIG. 9 is a rear view of the overload relay of FIGS. 2–4 with the housing partly broken away to show the relationship of the bimetals to the differential bars and the relationship of the crank to the actuating member of the switch.
Figure 20:
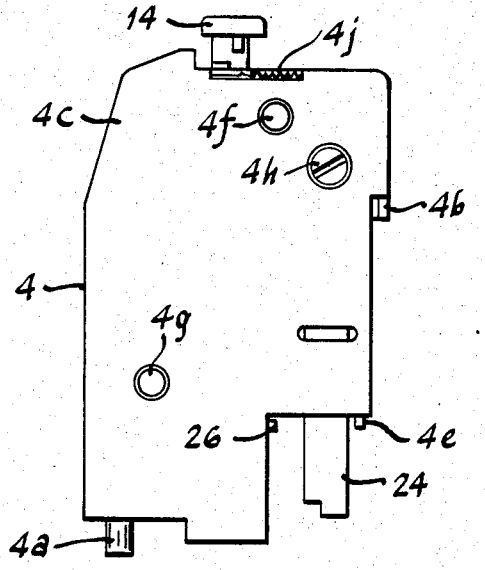
FIG. 20 is a right side elevational view of the switch of FIGS. 1 and 2 showing its mounting means and the compensating bimetal member.

For the three-phase overload relay shown in FIG. 1, three like thermal responsive means or bimetal supporting terminal brackets or lead subassemblies 16, 18 and 20 shown in FIGS. 2 and 5 are press-in or snap-in mounted within the relay housing. For this purpose, the relay housing is provided with three compartments 2*k*, 2*l* and 2*m* as shown in the top view in FIG. 8 which are defined by left wall 2*a*, which extends all the way up as shown in FIGS. 1 and 2, and interior walls 2*n*, 2*o* and 2*p* which extend part way up within the relay housing as shown in FIGS. 3 and 4. Rightmost inner wall 2*p* has a rectangular hole 2*q* in it as shown in FIG. 4 to provide space for the switch operating mechanism such as the differential bars 30 and 32 as shown in FIGS. 9 and 10. Switch housing 2 also has a short right wall 2*r* shown in FIGS. 8–10 extending a short distance upwardly and a short distance forwardly from rear wall 2*g* for enclosing the compartment 22 into which compensating bimetal member 24 of switch 4 is suspended and into which operating member 26 of switch 4 extends for actuation by crank 28 that is operated by the differential bars including driver bar 30 and follower bar 32 as shown in FIGS. 8–11. This partial wall 2*r* has a recess 2*s* at its upper forward inner surface to provide clearance for switch actuating member 26 as shown in FIGS. 8 and 9. Switch 4 has a short downwardly extending lug 4*e* integrally molded on its base 4*c* as shown in FIGS. 12 and 20 which slides inwardly of wall 2*r* as the switch is assembled onto the thermal relay housing to assist in maintaining the switch in its position along with the staked projection 4*a* and the dovetail lug 4*b* hereinbefore described.

Referring again to FIG. 8, it will be apparent that housing 2 of the relay is provided with means for receiving and rigidly retaining bimetal-supporting and connector lead supporting brackets 16, 18 and 20. These brackets 16, 18 and 20 are alike and one of them, bracket 6, shown in FIGS. 6 and 7, will be described. As shown in FIG. 6, this bracket 16 has a generally H-shaped configuration with its two upper arms 16*a* and 16*b* being longer than its two lower legs 16*c* and 16*d* and the upper ends of its upper arms being joined by an integral attachment platform 16*e*. A central tongue 16*f* extends upwardly from its lateral connecting portion 16*x* into the space between upper arms 16*a* and 16*b* and is offset to one side, left side in FIG. 2, in parallel relation to arms 16*a* and 16*b* as shown in the rear view in FIG. 7. The upper end portions of upper arms 16*a* and 16*b* between tongue 16*f* and platform 16*e* are connected by a narrow lateral strip 16*g* to which is secured as by welding a connector lead 16*h* that extends horizontally rearwardly through a slot in the rear wall of the housing of the overload relay as shown in FIG. 3 for connection to a contactor or the like. A bimetal strip 16*j* is rigidly secured as by projection welding or the like at its upper end to the upper parallel portion of tongue 16*f* so that it extends downwardly parallel to the lower portion of bracket 16 as shown in FIG. 7. The lower end portion of bimetal strip 16*j* has a reduced width portion 16*k* as shown in FIG. 6 so that it extends down freely through the openings between differential bars 30 and 32 as shown in FIG. 10 for reasons hereinafter described. Two pairs of spaced offset bumps 16*m* and 16*n* are formed next to the opposite edges of the lower portion of bracket 16 so as to fit with interference snugly into a pair of grooves or channels hereinafter described in the relay housing when the bracket is pressed down thereinto. A rectangular hole 16*o* is provided in the central lateral portion 16*x* of bracket 16 for snap-in and locking engagement with an integrally formed resilient tooth 2*t*, FIG. 8, on wall 2*n* in the relay housing when the bracket is pressed into place. Attachment platform 16*e* at the upper end of bracket 16 is provided with a threaded hole 16*p* for receiving a screw 16*q*, FIG. 2, to attach and electrically connect the connector clip of the cassette heater hereinafter described. As shown in FIG. 7, attachment platform 16*e* is bent downwardly at a predetermined small angle such as 9.5 degrees or the like toward the heater to automatically set the spacing between the heater and the bimetal strip when the screw is tightened as hereinafter more fully described.

As shown in FIG. 8, internal wall 2*n* has integrally molded on the left side thereof, the forward side as seen in FIG. 8, a pair of vertical ridges forming a pair of spaced vertical grooves or channels 2*u* and 2*v* facing forwardly and rearwardly, respectively, on opposite sides of integral snap-in tooth 2*t* for receiving the opposite edge portions of bracket 16 whereby formed rounded bumps 16*m* and 16*n* provide an interference fit with the opposite sides of these grooves to rigidly secure the bimetal supporting bracket in the housing. As bracket 16 is pressed down into grooves 2*u* and 2*v*, resilient plastic tooth 2*t* will flex and then snap into hole 16*o* in bracket 16 to permanently lock the bracket in the housing. Similar bracket securing grooves or channels and locking teeth are provided on internal walls 2*o* and 2*p* as shown in FIG. 8 for mounting brackets 18 and 20. The vertical ridge defining channel 2*v* as shown in FIG. 8 has an integral portion of lower height as shown in FIG. 3 extending all the way across compartment 2*k* to provide a wall 2*w* the upper surface of which forms a stop for the associated cassette heater 6 when it is assembled into its place on the overload relay. A similar wall 2*x* is provided in compartment 2*m* for cassette heater 10. However, in the central compartment 21 the stop wall 2*y* for the associated cassette heater 8 is formed integrally with and parallel to wall 2*o* to provide a passageway therealong having access to slots 2*b* in the front wall of the relay shown in FIGS. 1 and 2 and slot 2*z* in the rear wall of the relay housing for ventilation purposes. The upper surface of this wall 2*y* provides a stop for cassette heater 8 when it is snap-in mounted in place as hereinafter described.

Figure 18:
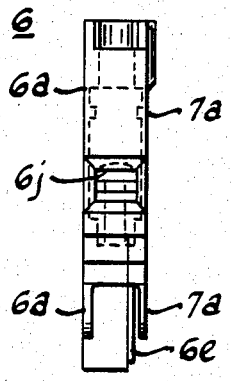
FIG. 18 is a front elevational view of one of the cassette heaters of FIG. 1 showing the pair of snap-in retention hooks and the wire entry hole.

As shown in FIGS. 3, 5 and 13, the relay housing is provided with a snap-in hold-down member 12 having the integrally molded release button 12*a* previously referred to in connection with FIGS. 1–3. As shown in the isometric view of FIG. 13, this hold-down device has a generally inverted U-shaped configuration with a pair of legs 12*b* and 12*c* and a lateral member 12*d* connecting the upper ends of the legs. Release button 12*a* having a generally cylindrical forward end portion extends forwardly from the center of connecting member 12*d*. Connecting member 12*d* is generally cylindrical in shape with double width notches 12*e* and 12*f* on opposite sides of button 12*a* and single width notches 12*g* and 12*h* at the ends thereof for receiving the pairs of snap-in hooks such as 6*a* and 7*a* in FIG. 18 of cassette heaters 6, 8 and 10. For this purpose, it will be apparent that the pair of hooks of cassette heater 8 straddle the base of pushbutton 12*a* and the pairs of hooks of cassette heaters 6 and 10 straddle the thicker portions 12*j* and 12*k* at the opposite ends of connecting member 12*d*, the hooks of cassette heater 6 entering notches 12*e* and 12*g* and the hooks of cassette heater 10 entering notches 12*f* and 12*h*. These hooks of one cassette heater 6 are shown in FIGS. 14, 15 and 18. Since cassette heaters 6, 8 and 10 are alike, the details of only one cassette heater 6 are shown in FIGS. 14 and 15 for illustrative purposes. As shown in FIG. 14, housing 6*a* of cassette heater 6 has a hook 6*b* integrally molded therewith and cover 7*a* shown in FIG. 15 has a hook 7*b* integrally molded therewith, these hooks 6*b* and 7*b* being suitably spaced from one another when the cover is assembled on the housing as shown in FIG. 18 to enter the notches of snap-in hold-down device 12 as hereinbefore described.

The snap-in hold-down device 12 of FIG. 13 is provided with means for mounting the same within relay housing 2 as shown in FIG. 3. For this purpose, the legs 12*b* and 12*c* of hold-down device 12 are provided with forwardly extending bifurcated snap-in securing and locking means or lugs 12*m* and 12*n* as shown in FIG. 13 which are inserted into holes 3*a* and 3*b* in the front wall of housing 2 as shown in FIG. 2 to lock the hold-down device within the relay housing. Each leg 12*b* and 12*c* of the hold-down device is provided with a pair of lateral rounded ridges 12*o* and 12*p*, one of these ridges being at the lower end of the leg and the other ridge being at the knee of the leg, below and above snap-in locking device 12*n*, so as to abut the inner surface of the front wall of the relay housing while snap-in locking device 12*n* holds the leg snugly against the inner wall of the housing. Also, the legs of hold-down device 12 are molded so that they are resilient and the upper portion of the hold-down device above the knees of the legs extends at a small angle inwardly of the relay housing thereby to provide clearance between the upper portion of the hold-down device and the inner wall of the housing for entry of the pairs of hooks of the several cassette heaters.

As shown in FIG. 14, the base of housing *6a* of the cassette heater 6 has suitable cavities and grooves for accommodating a planar heater element *6c* at the upper portion of which is secured as by riveting a connector clip *6d* and at the lower left-hand portion of which is secured as by riveting a connector *6e*. Connector clip *6d* is provided with an upper portion *6f* that has a screw receiving slot *6g* as shown in FIG. 14 and is bent to a predetermined angle such as substantially 80.5 degrees or the like so that it has the same angle with the horizontal as connector platform 16*e* of the bimetal supporting bracket 16 as shown in FIG. 7 for automatically spacing the heater correctly with respect to the bimetal when the heater is connected to bracket 16. For this purpose, the heater is first pressed down into the relay housing so that its hooks *6b* and *7b* cam past and snap onto and grip hold-down device 12. In this position slotted connector clip *6d* overlies tapped hole 16*p* in connector platform 16*e* of bracket 16. Then a screw 16*q* shown in FIG. 2 is dropped into the upper hole *6h* shown in FIG. 1 of the heater and turned into the tapped hole in platform 16*e*. Due to the angle on slotted connector clip *6d* which overlies connector platform 16*e* of the bracket, turning screw 16*q* tight will tend to draw the connector clip *6d* and the heater along with it to a predetermined spacing with the bimetal. As a result of this angle on the connector clips of all three heaters and the like angle on the connector platforms of brackets 16, 18 and 20, all three heaters will tend to be spaced equally and correctly with respect to the respective bimetal elements without requiring any additional adjustments after the heaters have been inserted in place and connected in the circuit with the three screws such as screw 16*q* shown in FIG. 2.

As shown in FIGS. 14 and 15, upper hole *6h* which receives the connector screw 16*q* is formed partly in the housing or base *6a* and partly in the cover *7a* of the heater. The housing *6a* and the cover *7a* of the heater are also molded so as to provide a hole *6j* at the forward midportion thereof as more clearly shown in FIG. 18, when the cover is assembled on the housing and connected thereto by rivets through a pair of aligned holes *6k* and *6l*, through which a stripped end of a connector wire may be inserted for connection to terminal *6e*. For this purpose, terminal *6e* is provided with a conventional connector screw *6m* having a clamping plate *6n* thereon as shown in FIG. 14. To provide access to screw *6m*, the housing and cover are molded so as to provide a hole *6x* thereabove for entry of a thin screwdriver or the like for turning the screw. Holes *6h* and *6x* are small enough to prevent entry of the user's finger for safety.

As shown in FIG. 16, heater *6c* is a thick film heater. This heater comprises a steel plate *6o* coated with electrically insulating porcelainized enamel or the like having good heat conductivity to provide a substrate. A thick film heater *6p* is then formed on the substrate by applying a thick film resistor paste by screen printing or the like which is then allowed to dry and is fired to form the resistor coating. Thereafter, thick film conductor paste is applied to form contact *6q* at the upper end portion of resistor *6p* and to form contact *6r* at the lower left-hand portions of resistor *6p*. As shown by the broken line in FIG. 16, conductor paste contacts *6q* and *6r* partially overlie thick film resistor *6p* to make electrical connection therewith. After conductor paste contacts *6q* and *6r* have been suitably dried and fired, terminal clip *6d* and screw terminal *6e* are riveted thereover to enable connection of the thick film resistor in the electrical circuit. As will be apparent, use of a thick film resistor on a flat substrate enables making of a very small and narrow overall heater package. Also, after the thick film heater has been formed on the substrate, it can be trimmed very accurately along broken line *6s* by use of a laser or abrasive trimming such as sand blasting to set its resistance value precisely. This type of heater is designed to withstand a wide range of currents and higher wattage such as 4 watts compared to prior ¼ watt types. This is an advantage because the currents to which it is subjected are unknown. Moreover, this type of flat heater element using a thick film resistor has an expansion characteristic matched to the substrate for durability. This type of flat, planar heater is much more economical, about 1/8 to 1/10 the cost of a wound wire heater and is more precise and more stable and can be constructed into a smaller flat package thereby enabling the construction of a thermal overload relay having smaller overall dimensions and lighter weight. Thick film heaters are preferably used for currents of 0.1 to 7 amps.

An alternative resistance element 40 is shown in FIG. 19. As shown therein, this resistor 40 is stamped from flat resistance material such as copper-nickel alloy or the like and is provided with a pair of holes 40*a* and 40*b* for riveting a connector clip such as connector clip *6d* shown in FIG. 17 to its upper portion and for riveting a connector such as connector *6e* shown in FIG. 14 to its lower left-hand portion like those used with the thick film heater, or they could be welded. This resistor element 40 is dimentioned to provide the desired total resistance between its two terminals and is preferably used for currents of 7 to 64 amps.

The differential operating mechanism shown in FIGS. 9–11 will now be described. As shown in FIG. 11, driver bar 30 has the configuration of a generally horizontal slide member 30*a* with an integral upstanding projection 30*b* at its left end. Slide portion 30*a* has a pair of rectangular holes 30*c* and 30*d* therethrough with an integral lug 30*e* at the left side of hole 30*c* shown in FIG. 10, an integral lug 30*f* at the left side of hole 30*d* and an integral lug 30*g* at the right-hand end of driver bar 30 against which the three lower end portions 16*k*, 18*k* and 20*k* of the bimetal strips bear for sliding driver bar 30 in the left-hand direction when one or more of the bimetals deflects under thermal conditions. The upper end of upstanding projection 30*b* of driver bar 30 has a hole for journaling lower pivot pin 28*a* of crank 28.

Follower bar 32 shown in FIG. 11 also has a generally flat horizontal slider portion 32*a* that also has two holes 32*b* and 32*c* therethrough and a slot 32*d* at its left end. Lugs 32*e* and 32*f* are integrally molded on the right-hand sides of holes 32*b* and 32*c* as shown in FIG. 11 and a similar lug 32*g* shown in FIG. 10 is provided on the right-hand side of slot 32*d* against which the lower end portions 16*k*, 18*k* and 20*k* of the respective bimetal strips bear to move follower bar 32 in the right-hand direction under cooling conditions or for restraining leftward sliding movement of follower bar 32 by one or more of the bimetal elements when one or more of the other bimetal elements deflects in the left-hand direction for differential action. The left-hand end portion of follower bar 32 has an upstanding projection 32*h* with a hole 32*i* therethrough for receiving and journaling upper pivot pin 28*b* of crank 28. Plastic molded crank 28 also has an upstanding actuator projection 28*c* covered by a sleeve of resilient plastic material 28*d* or the like for applying a force on switch actuator 26 as shown in FIGS. 9 and 10. A snap-in cover 42 shown in FIGS. 3, 9 and 10 closes a hole in the bottom of relay housing 2 through which the driver and follower bars and crank are inserted and provides a surface on which driver bar 30 slides, groove 42*a* in the upper surface thereof providing clearance for the lower tips of the bimetal strips.

The operation of driver bar 30, crank 28 and follower bar 32 will not be described. First, let it be assumed that all three bimetals respond to an increasing temperature, either increasing ambient temperature or increasing temperature due to current flowing through the associated heater elements or both. This will cause the lower ends of the bimetal elements to deflect toward the switch side of the thermal overload relay. This direction of deflection is in the left-hand direction as viewed in FIGS. 7, 9 and 10 where the relay is being viewed from the back side and in the right-hand direction when viewed from the front as in FIG. 2. As shown in FIGS. 6 and 7, lower legs 16*c* and 16*d* of bracket 16 are wide enough apart to provide clearance therebetween for bimetal element 16*j* if this bimetal element deflects that far under severe overload conditions. Such deflection of the bimetal elements will slide driver bar 30 in the left-hand direction in FIG. 10. As a result, driver bar 30 will rotate crank 28 in a clockwise direction just enough so that actuator projection 28*c*, 28*d* thereof will abut switch actuator 26 but will not actually depress it because follower bar 32 is free to move also in the left-hand direction. Whenever the ambient temperature increases, compensating bimetal member 24 shown in FIG. 10 correspondingly deflects in the left-hand direction an equal amount as the deflection of bimetal members 16*j*, 18*j* and 20*j* due only to ambient temperature increase. However, the latter three bimetal members deflect further in the left-hand direction due to overload current flowing through the associated heaters so that eventually forward projection 32*j* of follower bar 32 abuts compensating bimetal member 24 which stops the leftward movement of this follower bar. Further movement of driver bar 30 then causes clockwise rotation of crank 28 in FIG. 10 so that operating projection 28*c*, 28*d* thereof depresses switch actuator 26 to trip the switch open. Thereafter, the three bimetal members will cool and deflect back in the right-hand direction as seen in FIG. 10 carrying follower bar 32 therewith. Since driver bar 30 is coupled through crank 28 to the follower bar, driver bar 30 will also slide back in the right-hand direction. Switch 4 may be reset by depressing reset button 14 to reclose the contacts. The left to right position of compensating bimetal member 24 may be adjusted at factory adjustment screw 4*h* and customer trip current selector 4*i*, FIGS. 1 and 20, to set the current level at which the overload relay will trip. Switch 4 may be similar to that shown in our copending application Ser. No. 453,208, filed Dec. 27, 1982, with a compensating bimetal as, for example, in aforementioned U.S. Pat. No. 4,096,465, or F. N. Woodger U.S. Pat. No. 3,800,260, dated Mar. 26, 1974.

Let it now be assumed that there is a differential in the currents flowing in the several phases of the system. For example, this could cause one of the bimetal members to deflect more than another one. As a result, the deflecting bimetal member will move driver bar 30 in the left-hand direction while the other bimetal member that does not deflect as much will restrain follower bar 32 from moving an equal distance. This differential in the movements of driver bar 30 and follower bar 32 will cause crank 28 to rotate in the clockwise direction in FIG. 10 to trip the switch. The current differential in two of the phases at which the switch will trip is determined by the dimensions of the driver and follower bars and the points of coupling of crank 28 thereto.

Conductors 16*h*, 18*h* and 20*h*, FIG. 2 at the rear of the overload relay are given a length such that when lug 20*c* at the rear of the overload relay is coupled to a contactor or the like, these conductors will automatically extend into the terminals of the contactor whereupon the terminal screws can be tightened to electrically connect the overload relay to the contactor. Stripped end conductors from the electrical supply may then be inserted into the front holes such as 6*j*, FIG. 18, to connect the three heaters to the electrical supply, the contactor being connected through a load to the other side of the supply. Thus, when there is an overload condition on the line, switch 4 will trip and deenergize the contactor to open the circuit to the load and protect the same.

Referring again to FIG. 7, it will be apparent that the 9.5 degree slope at the top of bracket 16 provides an advantage in packaging in that the heaters can then be installed and removed in any sequence but it also affords an advantage in bimetal alignment with respect to the associated heater when an electrical screw connection is made between the thin terminal clip 6*f* at the top of the heater and the bracket platform 16*e* as a result of which the angle will tend to snug the heater over next to the bimetal and will set the dimension between the bimetal and the heater surface so that the dimensions of all three heater-bimetal combinations will be the same. This automatic adjustment of the spacing between the bimetal and the heater comes about because, due to the slope of the platform and the terminal clip, as the screw is tightened there will be a component of force tending to move the heater in the direction of the bimetal against a stop when the vertical portion of the connector clip or its rivet abuts the bracket. On the other hand, if the angle were set at 90 degrees, there would be no similar force tending to align the heater with the bimetal or to set the spacing and the spacings in the several phases could differ.

Also, bracket 16 shown in FIG. 6 and brackets 18 and 20 which are similar to it are designed to provide several advantages. For this purpose, it will be apparent that the current enters platform 16*e* where it enters from the associated heater and then the current splits in two and flows down the two outside arms 16*a* and 16*b* above lateral strip 16*g* and then through lateral strip 16*g* into lead 16*h*. During short circuit conditions, the current here is split so as to lessen the magnetic effects. It will be apparent that the hot spot in the entire structure is the center of the heater. If platform 16*e* were connected directly to the contactor, there would be a high heat loss out that back terminal and the overload relay would actually be heating the contactor with the overload current. By forcing the current to flow through this terminal 16*e* and to cycle partly through the bracket again before it is passed to the contactor, it is possible to use a part of this bracket as a heat sink, thus reducing the effect of heating a contactor.

The arms 16*a* and 16*b* below the lateral strip 16*g* where lead 16*h* is welded are provided for flexibility. If wire 16*h* is moved to one side or the other or is pulled on, this structure will prevent the bimetal from moving thereby providing a mechanical flexing joint. Also, when the screw is tightened on platform 16*e*, this structure prevents disturbing of the bimetal position because the two outside edges of the legs of the bracket 16 are rigidly supported in the housing so that even though arms 16*a* and 16*b* should flex, the bimetal will remain in its position. This provides a mechanical advantage. The space between the heater and the bimetal is about 0.025 inch.

In FIG. 20, rivets 4*f* and 4*g* hold the cover to the base or housing of the switch. Screw 4*h* and selector 4*i*, FIGS. 1 and 20, are used to set the current level at which the switch will trip by setting the position of compensating bimetal 24. And mechanism 4*j* at the top of the switch is used to select the mode of operation for reset lever 14.

While the apparatus hereinbefore described is effectively adapted to fulfill the objects stated, it is to be understood that the invention is not intended to be confined to the particular preferred embodiment of reduced-sized thermal overload relay disclosed, inasmuch as it is susceptible of various modifications without departing from the scope of the appended claims.

We claim:

1. A reduced-size thermal overload relay for a control system having a plural-phase A.C. source supplying a load comprising:

an insulating open-top housing having a plurality of narrow compartments at its lower portion and a lateral space therebelow;

a plurality of thermal responsive means for the respective phases of said system;

a plurality of conductive brackets mounted in said housing supporting said thermal responsive means so as to extend down through said compartments into said space therebelow;

a plurality of terminal leads connected to the respective brackets for connection to an external device;

a plurality of narrow cassette heaters at the top of said housing having flat heater elements mounted in insulating enclosures leaving one side of said heater elements exposed and terminals for electrically connecting said heater elements to the respective phases of said system to be heated by the currents therein;

connecting and positioning means for electrically connecting said heater elements to the respective brackets and therethrough to said terminal leads and concurrently positioning said exposed sides of said heater elements relative to the respective thermal responsive means to heat the latter according to the currents in the respective phases of said system;

a switch mounted at one side on said housing and having terminals connectable to a control device for protection of said system;

and actuator means in said space below said compartments responsive to said thermal responsive means under overload conditions for operating said switch.

2. The reduced-size thermal overload relay claimed in claim 1, wherein:

said narrow cassette heaters fill said open top of said housing in contiguous side-by-side relation.

3. The reduced-size thermal overload relay claimed in claim 1, wherein:

each said conductive bracket comprises:

a generally H-shaped member having a pair of spaced legs extending downwardly and a pair of spaced arms extending upwardly and a lateral connecting portion therebetween;

and an integral center strip extending upwardly from said lateral connecting portion and offset to one side from the plane of said legs, to which said thermal responsive means is secured.

4. The reduced-size thermal overload relay claimed in claim 3, wherein:

said thermal responsive means comprises a flat bimetal member rigidly secured at its upper end portion to said upstanding center strip so as to extend downwardly therefrom substantially parallel to the legs of said bracket.

5. The reduced-size thermal overload relay claimed in claim 4, wherein said connecting and positioning means comprises:

an integral flat member joining the upper ends of said arms which have a bend so that said flat member forms a platform;

a terminal clip electrically connected to the heater element of the respective heater and having a connector portion having a bend toward and overlying said platform of said bracket;

and means clamping said terminal clip to the platform of said bracket to electrically connect the same.

6. The reduced-size thermal overload relay claimed in claim 5, wherein:

said bend of said arms is sufficient to give said platform a predetermined small angle downward from horizontal;

said bend of said connector portion is such as to give said connector portion said predetermined small angle upward from horizontal so that when said connector portion which overlies said platform is clamped to said platform the resultant force component will tend to snug the associated heater toward the bimetal member to set the spacing therebetween so that the spacing between all heaters and respective bimetal members will be the same without further adjustment.

7. The reduced-size thermal overload relay claimed in claim 4, wherein:

said bracket comprises a lateral strip between said arms below said integral flat member;

and the respective terminal lead is connected to said lateral strip so that the current flowing through the respective heater element will split and flow down through the upper portions of said arms into said lateral strip thereby to lessen the magnetic effect from said current flow and to reduce the heat being lost out through said terminal lead.

8. The reduced-size thermal overload relay claimed in claim 7, wherein:

said arms are flexible between said terminal lead and said lateral connecting portion to provide mechanical decoupling so as to prevent disturbing the bimetal member position if said terminal lead is moved or stressed.

9. The reduced-size thermal overload relay claimed in claim 8, wherein:

said platform is provided with a tapped hole for receiving a screw to clamp said connector portion of said clip to said platform of said conductive bracket.

10. The reduced-size thermal overload relay claimed in claim 4, wherein said housing comprises:

a plurality of walls defining said narrow compartments;

a pair of vertical, channeled ridges on one of said walls of each said compartment forming a vertical slide for receiving the outer edges of said pair of legs of said H-shaped member when pressed downwardly thereinto;

abutments for limiting the downward depression of said H-shaped member so that all three bimetal members will be positioned equally within said housing;

and means for snap-in locking said H-shaped members within said housing.

11. The reduced-size thermal overload relay claimed in claim 2, wherein said connecting and positioning means comprises:

a resilient hold-down device mounted within said housing and having a release button extending to the exterior thereof;

and hooks on said cassette heaters for snap-in engaging said hold-down device when said heaters are inserted down into the top of said housing.

12. The reduced-size thermal overload relay claimed in claim 1, wherein:

said housing comprises a pair of mounting holes and an access hole for said release button;

said hold-down device comprises a generally inverted U-shaped resilient member having said release button extending forwardly from the upper center portion thereof into and through said access hole in said housing;

a pair of snap-in mounting lugs at the lower portions of the legs of said hold-down device rigidly secured in said pair of mounting holes;

inward bends at the midportions of said legs for spacing the upper portion of said hold-down device from the inner front wall of said housing;

and said hooks enter between said inner front wall of said housing and said upper portion of said hold-down device, bias said upper portion inwardly and snap therebelow when said heaters are inserted in said housing to hold said heaters down within said housing.

13. The reduced-size thermal overload relay claimed in claim 1, wherein:

each said flat heater element comprises a thick film resistance heater.

14. The reduced-size thermal overload relay for a control system having a plural-phase A.C. source supplying a load comprising:

an insulating housing having a plurality of narrow compartments therein;

a plurality of mounting brackets held in said housing and having first terminals of respective pairs thereof for connecting the same to the respective phases of said system;

a plurality of thermal responsive means for the respective phases supported by said brackets in said compartments;

a switch mounted on said housing and having terminals connectable to a control device for protection of the system;

direct and differential actuator means coupling said thermal responsive means to said switch to trip said switch either when said plurality of thermal responsive means respond in unison to a preset thermal level or when a pair of said plurality of thermal responsive means sense and respond to a predetermined differential thermal level therebetween;

a plurality of cassette heaters for the respective thermal responsive means having second terminals of said respective pairs thereof for connecting the same to the respective phases of said system to be heated by the currents of said phases;

snap-in means for mounting said cassette heaters in said housing adjacent the respective thermal responsive means for ready removal and replacement;

and connecting and positioning means for electrically connecting said cassette heaters to the respective brackets and therethrough to said first terminals and concurrently positioning said cassette heaters relative to the respective thermal responsive means to heat said thermal responsive means proportional to the currents in the respective phases of said system.

* * * * *